US005157789A

United States Patent [19]

Klass

[11] Patent Number: 5,157,789

[45] Date of Patent: Oct. 27, 1992

[54] HIP PROTECTIVE HOSPITAL GARMENT

[76] Inventor: Joel V. Klass, 3700 Washington St., Hollywood, Fla. 33021

[21] Appl. No.: 790,227

[22] Filed: Nov. 8, 1991

[51] Int. Cl.[5] ..... A41D 13/00

[52] U.S. Cl. ..... 2/114; 2/2.5; 2/46; 2/69; 2/247; 2/267; 2/DIG. 7

[58] Field of Search ..... 2/2, 2.5, 46, 69, 69.5, 2/79, 94, 114, 247, 267, 268, DIG. 7

[56] References Cited

U.S. PATENT DOCUMENTS

| | | | |
|---|---|---|---|
| 782,819 | 2/1905 | Biklé | 2/114 X |
| 992,376 | 5/1911 | Moore | 2/267 |
| 2,332,141 | 10/1943 | Greene | 2/267 |
| 2,556,931 | 6/1951 | Miller | 2/114 |
| 2,790,973 | 5/1957 | Lewis, Jr. et al. | 2/2.5 |
| 2,807,022 | 9/1957 | Bonanni | 2/114 |
| 3,135,961 | 6/1964 | Roderick | 2/2 |
| 3,343,537 | 9/1967 | Graham | 2/114 X |
| 3,490,072 | 1/1970 | Keltner | 2/114 |
| 3,633,215 | 1/1972 | Richards | 2/69.5 |
| 4,128,902 | 12/1978 | Siebert | 2/2 |
| 4,338,686 | 7/1982 | Bell | 2/2 X |
| 4,462,115 | 7/1984 | Carlson et al. | 2/2 |
| 4,485,491 | 12/1984 | Rasmussen | 2/2.5 |
| 4,535,478 | 8/1985 | Züfle | 2/2.5 |
| 4,570,268 | 2/1986 | Freeman | 2/114 |
| 4,601,067 | 7/1986 | Buonassissi | 2/2.5 X |
| 4,622,699 | 11/1986 | Spriggs | 2/114 |
| 4,637,075 | 1/1987 | Ingrisano et al. | 2/DIG. 7 X |
| 4,737,994 | 4/1988 | Galton | 2/2 |
| 4,807,301 | 2/1989 | Ferber | 2/2 |
| 4,870,706 | 10/1989 | Ketcham et al. | 2/2 |
| 5,007,111 | 4/1991 | Adams | 2/2 X |
| 5,034,998 | 7/1991 | Kolosky | 2/2 |
| 5,038,779 | 8/1991 | Barry et al. | 2/267 X |
| 5,052,052 | 10/1991 | Gilford et al. | 2/69 X |
| 5,068,920 | 12/1991 | Bray | 2/2 X |

FOREIGN PATENT DOCUMENTS

| | | | |
|---|---|---|---|
| 3530397 | 3/1987 | Fed. Rep. of Germany | 2/2 |
| 2635650 | 3/1990 | France | 2/2 |

*Primary Examiner*—Werner H. Schroeder
*Assistant Examiner*—Jeanette E. Chapman
*Attorney, Agent, or Firm*—Malloy, Downey & Malloy

[57] ABSTRACT

A hip protective hospital garment, adapted for use by individuals of all sizes, which includes a gown having a lower portion, a pair of upper chest flaps, and a pair of shoulder flaps, wherein the upper chest flaps are adjustably and criss-crossingly connected with the pair of shoulder flaps so as to provide a comfortable, quick, and non-restrictive fit on the individual user. Extending across an interior side of the lower portion is a large, sealable pocket disposed in substantially covering relation to the hips and upper thighs of the wearer, the pocket being structured to receive at least one lightweight, flexible, impact protective air bubble material liner therein so as to provide a protective area that will substantially absorb a force of impact to the hip area of the wearer, and thereby reduce the severity of injuries which may occur from accidental falls. The protective air bubble liner is so situated as to serve the added purpose of reducing risk of stasis ulcers or bed sores.

6 Claims, 2 Drawing Sheets

HIP PROTECTIVE HOSPITAL GARMENT

BACKGROUND OF THE INVENTION

1. Field of the Invention

This invention relates to a hip protective hospital garment adapted to be comfortably and non-restrictively worn by a hospital patient and including an interior or exterior pocket for receipt of at least one protective material liner therein, thereby protectively covering the hips and upper thighs of the user and providing the user with a comfortable and effective means of protecting against bed sores or severe injuries as the result of a fall.

2. Description of the Prior Art

Many hospital and nursing home patients, a large number of whom may be elderly individuals, may be bedridden or wheelchair-bound for extended periods of time, or have physical impairments. This makes it difficult for them to walk and makes them prone to falls resulting in severe injuries as a result of their age or health condition. As a result, there is a need for a hospital garment that while being geared for the functionality, unrestrictiveness, and comfort of an ordinary hospital garment, will also provide an effective means of protecting vulnerable areas of the individual.

In the past, other hip protective garments have been devised, such as in U.S. Pat. No. 3,964,475, U.S. Pat. No. 4,981,307, U.S. Pat. No. 4,870,706, and U.S. Pat. No. 4,807,301. Unfortunately, none of the referenced designs fully meet the needs of a health care environment. For example, U.S. Pat. No. 3,964,475 discloses a highly constricting and uncomfortable garment and is not specifically directed towards absorbing the shock of a fall. U.S. Pat. No. 4,981,307 discloses a harness and body jacket which is clumsy and does not provide for ambulatory patients. Further, this garment is expensive, and does not allow for flexible movement. U.S. Pat. No. 4,870,706 discloses a garment which is used for athletic purposes and provides air channels which are not adapted to absorb the shock of a fall as well as in the applicant's invention. This garment is also restrictive and unsuited for hospital use. Finally, U.S. Pat. No. 4,807,301 discloses a garment which clings to the body and does not allow for heat disbursement, nor does it allow facilitated access to the individual's body, a primary purpose of a hospital gown. In view of the foregoing, there is still a need in the prior art for a functional hospital gown which provides for a protective shock absorbent means therein.

Applicant's invention is specifically designed with a health care environment in mind. The inexpensive protective material liner may be easily removed to allow for cleaning of the gown, and the gown is adjustable so that it may be used by a variety of user's, thereby making it a cost effective garment. Further, applicant's invention provides extensive protection to the needed areas, while still being uncumbersome, lightweight, and accessible for medical treatment. Additionally, applicant's invention is a front fastening garment that utilizes quick and easy fastening means, thereby providing a garment that is favorable not only to the user who may feel awkward wearing the usually employed immodest open backed garment, but also to health care workers who will have an easier time fitting and fastening the gowns on patients.

SUMMARY OF THE INVENTION

The present invention is directed towards a hip protective hospital garment, to be worn by individuals of varying sizes. The hip protective garment includes a lower portion, a pair of upper chest flaps, and a pair of shoulder flaps integrally formed of a single material sheet so as to form a frontally fastened gown. The shoulder flaps are adjustably and correspondingly secured to the pair of criss-crossing upper chest flaps, thereby providing a comfortable, adjustable, and partially removable, support means for the garment on the individual user. Located in an interior or exterior of the gown and extending across the lower portion is a substantially large, sealable pocket which is structured and disposed to substantially cover the mid-section of the individual user. Positioned within the interior pocket is at least one substantially lightweight, flexible, high impact protective air bubble material liner structured and disposed to protect the mid-section of the user from severe injury due to impacts that may occur if the individual should fall, as well as to reduce the likelihood and/or severity of bed sores which may occur when a patient is in a wheelchair or bedridden for extended periods. The interior pocket includes closure means structured so as to securely contain the air bubble material liner within the pocket when in use, while facilitating removal of the material liner for cleaning. Finally, adjustable gown closure means are included to enable the gown to be quickly and securely closed in the front, about wearers of varying sizes.

In some instances, the garment may be preferentially worn in reverse direction with the gown applied in front and fastened in the back. Overlap of the side panels maintains body 74 coverage for modesty.

It is an object of the present invention to provide a comfortable, uncumbersome, yet highly protective hospital garment.

It is also an object of the present invention to provide a cost effective, adjustable, and reusable dual purpose hospital garment.

It is yet another object of the present invention to provide a frontally and easily closing garment which a user may feel more comfortable about wearing than an open backed garment and which eliminates the difficulties of buttons, snaps, and ties.

Additionally, it is an object of the present invention to provide an adjustable garment that provides facilitated access to the user for medical treatment.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 2:
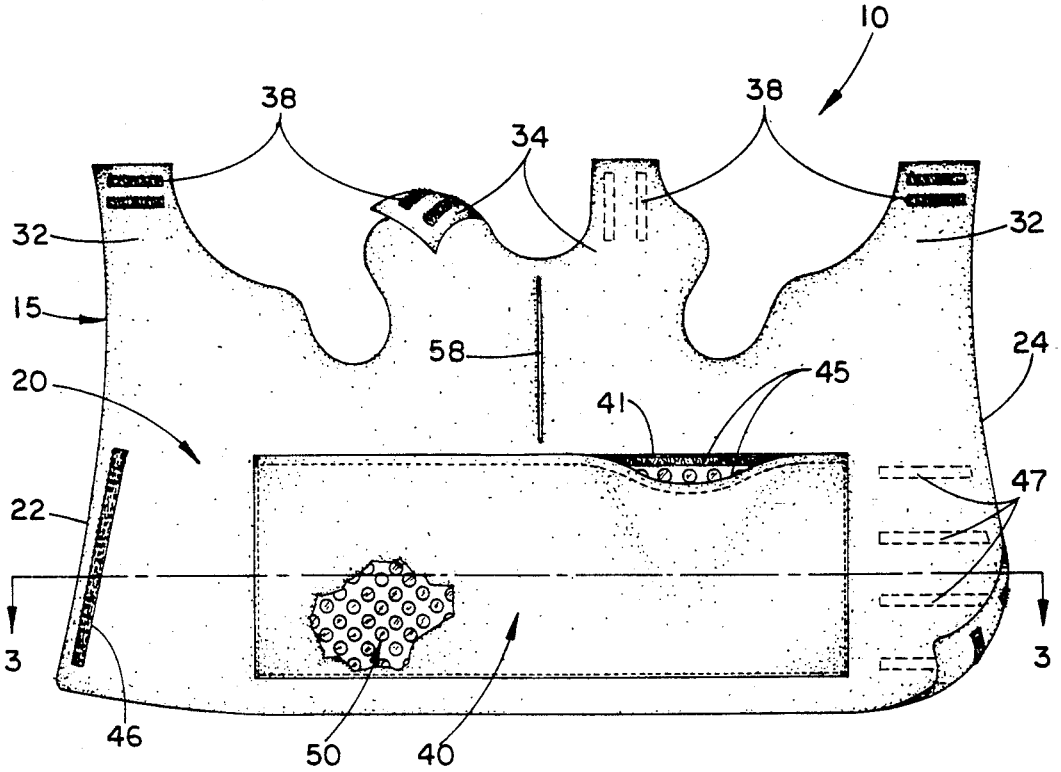
FIG. 2 is a rear, partial cutaway view of the protective hospital garment.
Figure 1:
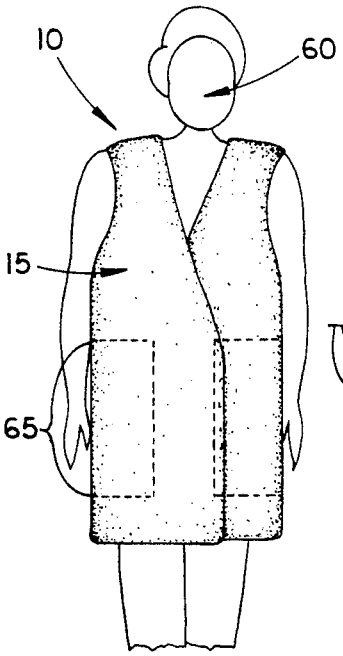
FIG. 1 is a perspective view of the protective hospital garment worn by a user.
Figure 3:
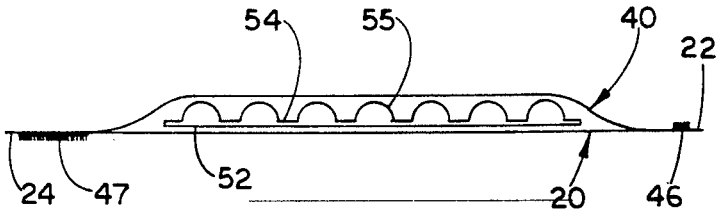
FIG. 3 is a cross-sectional view of the protective hospital garment along line 3—3 of FIG. 2.

As shown throughout FIGS. 1-3, the present invention is directed towards a frontally closing, hip protective, hospital garment generally indicated as 10.

Referring initially to FIG. 1, the protective hospital garment 10 is structured to provide the functionality of an ordinary hospital gown and is adjustable so that it may be worn by individual users 60 of varying sizes. As best shown in FIG. 2, the protective hospital garment 10 includes primarily a gown 15 having a lower portion 20 integrally formed from a single material sheet with a pair of upper chest flaps 32 and a pair of shoulder flaps 34. The upper chest flaps 32 and shoulder flaps 34 are adjustably connected thereby enabling the protective hospital garment 10 to be supportably and comfortably worn on the shoulders of the individual user 60. The chest flaps 32 and shoulder flaps 34 are adjustably secured using hook and loop fasteners 38 which are disposed in generally perpendicular relation to one another thereby providing a wider range of adjustability and in more secure fit. Further, an individual chest flap 32 may be pulled down to allow even greater access to the individual user 60 during medical treatment.

Included on an interior portion of the gown 15 and extending substantially across the lower portion 20 is a substantially large, sealable interior pocket 40. The interior pocket 40 is structured and disposed to be sufficiently large to cover the mid-section 65 of the individual user 60. The interior pocket 40 further includes hook and loop closure means 45 extending along an upper edge 41 of the interior pocket 40 so as to securely contain at least one air bubble material insert 50 in pocket 40 while allowing the material to be removed during cleaning of the hospital garment 10.

The air bubble material 50 is sized and configured for insertion within the pocket 40 and is preferably formed of a substantially lightweight, flexible, high impact protective material. The air bubble material liner 50, detailed in FIG. 3, includes a base sheet 52 and an upper sheet 54 attached to one another so as to form a plurality of air bubbles 55 evenly disposed throughout the material liner 50. The air bubble material liner 50 is adapted to provide a cushion surface for a bedridden patient, thereby reducing the likelihood of bed sores. Equally as important, the air bubble material liner 50 is structured and disposed within the gown to effectively absorb the shock of impacts which may result should an individual user 60 fall. In this case, the force of impacts will be evenly dispersed and absorbed, thereby reducing the likelihood and severity of potential injuries. The base sheet 52 and upper sheet 54 of the air bubble material liner 50 are securely attached such that the air bubbles 55 while being capable of withstanding and dispersing the shock of impacts will not be punctured as a result of the impact.

In order to maintain the gown 15 in a substantially closed position over the front of the individual user 60, hook and loop fasteners 46 and 47 are disposed along opposite vertical edges 22 and 24 of the lower portion 20 of the gown 15, such that a vertical edge 22 including vertically disposed hook and loop fastener portions 46 will be positioned in secure, overlapped relation over the vertical edge 24 including a plurality of horizontally positioned hook and loop fastener portions 47. Accordingly, the gown 15 may be comfortably worn about individual users 60 having mid-sections 65 of varying diameters.

Further, as illustrated in FIG. 1, at least one pocket 48 for carrying glasses or other like items is provided as part of the protective hospital garment 10.

Figure 4:
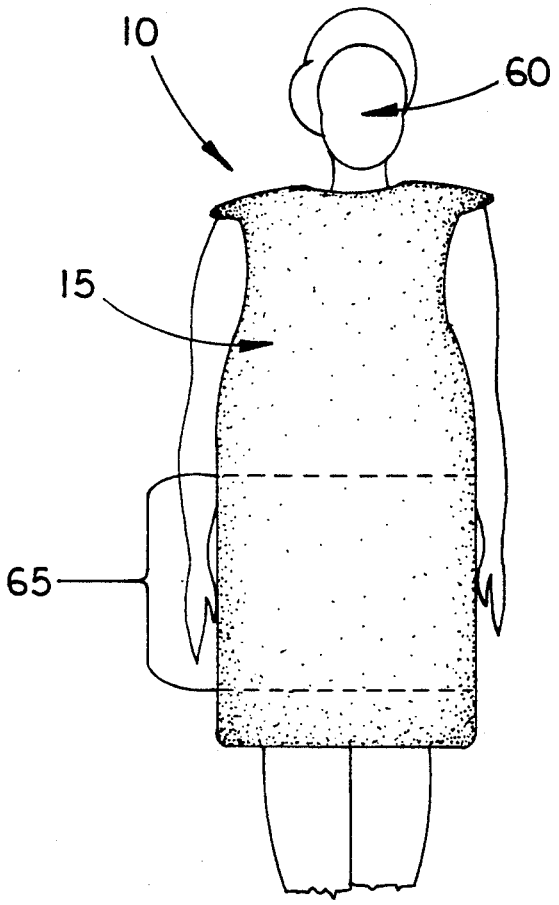
FIG. 4 is a perspective view of the protective hospital garment being worn in a reversed orientation.

Finally, as shown in FIG. 4, the garment 10 may be worn in reverse orientation.

Now that the invention has been described,

What is claimed is:

1. For use by individuals of varying sizes, a hip protective, hospital garment comprising:

a gown including a lower portion, a pair of upper chest flaps, and a pair of shoulder flaps, each of said pair of shoulder flaps being criss-crossingly and adjustably secured to correspondingly positioned ones of said pair of upper chest flaps so as to provide a comfortable and non-restrictive fit over the shoulders of the user, shoulder adjustment means to enable adjustable and easily disengageable securement of said shoulder flaps and said upper chest flaps, thereby providing facilitated access to the user's body and enabling quick and easy donning of the garment on the user, eliminating the need for the user to maneuver, adjustable gown closure means disposed along opposite vertical edges of said lower portion so as to secure said gown about the individual user, a substantially large, sealable interior pocket extending across said lower portion in an interior of said gown, which is structured and disposed to substantially cover the mid-section of the individual user when the garment is being worn, pocket closure means to seal said interior pocket, at least one substantially lightweight, flexible, highly impact protective material liner structured and disposed to substantially absorb a force of impact thereto and being sized and configured to be contained within said interior pocket to reduce the likelihood of bed sores to bedridden users or severe injury to the mid-section of the user as a result of an external force applied thereto, and said liner including a base sheet and an upper sheet attached to one another so as to form a plurality of evenly disposed air bubbles therebetween structured and disposed to absorb the shock of impacts thereto.

2. A garment as recited in claim 1 wherein said pocket closure means includes a hook and loop fastener.

3. A garment as recited in claim 2 wherein said shoulder adjustment means includes perpendicularly disposed hook and loop fasteners positioned on an interior of said upper chest flaps and an exterior of said shoulder flaps.

4. A garment as recited in claim 3 wherein said garment includes at least one exterior pocket.

5. A garment as recited in claim 4 wherein said adjustable gown closure means includes a plurality of perpendicularly disposed hook and loop fasteners secured at opposite distal ends of said lower portion such that said gown will remain in a comfortable, sealed, overlapping position over the front of the individual user.

6. A garment as recited in claim 5 wherein a centered, vertical slit is cut in said gown to allow facilitated access to the back of the individual user.

* * * * *